US006373173B1

(12) United States Patent
Suzuki

(10) Patent No.: US 6,373,173 B1
(45) Date of Patent: Apr. 16, 2002

(54) SPARK PLUG

(75) Inventor: Akira Suzuki, Nagoya (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 09/490,688

(22) Filed: Jan. 24, 2000

(30) Foreign Application Priority Data

Jan. 25, 1999 (JP) ..... 11-015679

(51) Int. Cl.[7] ..... H01T 13/20; H01T 13/12
(52) U.S. Cl. ..... 313/143; 313/141; 313/135
(58) Field of Search ..... 313/118, 132, 313/135, 137, 143, 144, 145, 141, 142

(56) References Cited

U.S. PATENT DOCUMENTS

| | | | | |
|---|---|---|---|---|
| 3,186,209 A | | 6/1965 | Friedman | 72/334 |
| 5,088,311 A | | 2/1992 | Inoue | 72/333 |
| 6,160,342 A | * | 12/2000 | Nishikawa et al. | 313/136 |
| 6,310,430 B1 | * | 10/2001 | Moriya | 123/169 EL |
| 6,334,800 B1 | * | 1/2002 | Nishikawa et al. | 445/7 |

FOREIGN PATENT DOCUMENTS

| | | |
|---|---|---|
| EP | 0 036 050 | 3/1984 |
| GB | 782944 | 9/1957 |
| GB | 944531 | 12/1963 |
| JP | 2774357 | 4/1998 |

* cited by examiner

*Primary Examiner*—Nimeshkumar D. Patel
*Assistant Examiner*—Karabi Guharay
(74) *Attorney, Agent, or Firm*—Finnegan, Henderson, Farabow, Garrett & Dunner LLP

(57) ABSTRACT

A spark plug according to this invention includes an elongate center electrode, an insulator enclosing the center electrode, a metallic shell having open opposite ends and enclosing the insulator, the metallic shell having a male-threaded portion formed on a front-side outer circumferential surface of the metallic shell, and a tool engagement portion formed on the outer circumferential surface of the metallic shell at a rear side with respect to the male-threaded portion, the tool engagement portion projecting circumferentially outwardly, and a ground electrode connected to the metallic shell and defining a spark discharge gap in cooperation with the center electrode. The size of the tool engagement portion is reduced such that |A–E| is not greater than 1.5 mm, where A is an outside dimension of the tool engagement portion, and E is an effective diameter of a male-threaded portion of the metallic shell. Also, the effective diameter E of the male-threaded portion of the metallic shell and the diameter $D_2$ of an intermediate-bore portion of the metallic shell are determined such that the relationship $0.4 \leqq (D_2/E)^2 \leqq 0.6$ is satisfied. Therefore, even when the outside diameter of the insulator decreases in association with a reduction in the size of the tool engagement portion, the wall thickness of the male-threaded portion of the metallic shell falls within an appropriate range, and a forging punch is less susceptible to breakage and is less likely to cause a working defect during forging of the metallic shell.

11 Claims, 9 Drawing Sheets

FIG. 4A
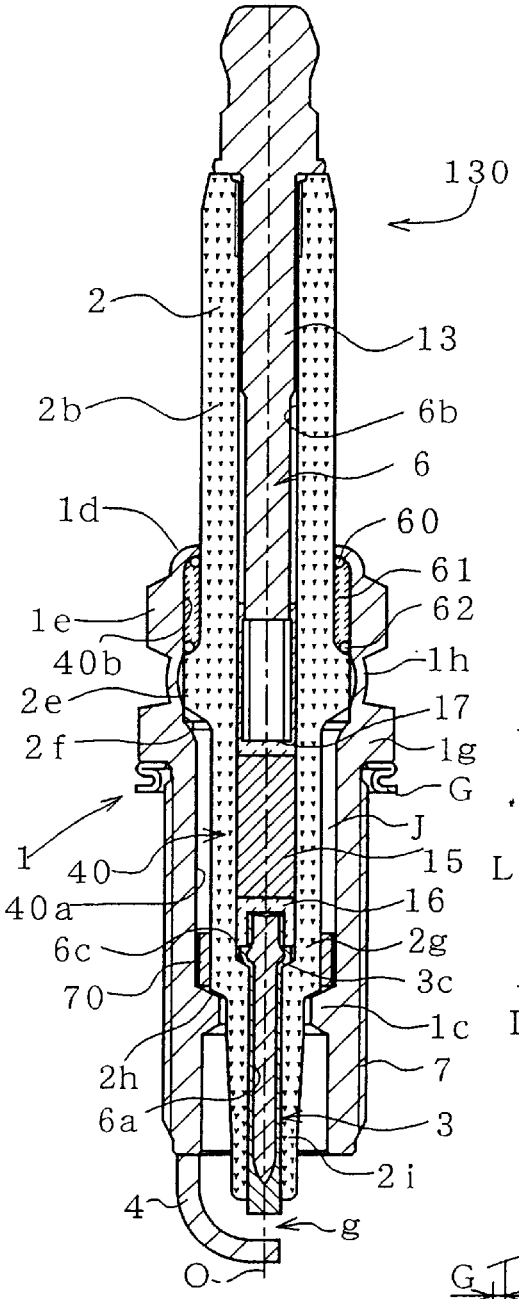
FIG. 4B
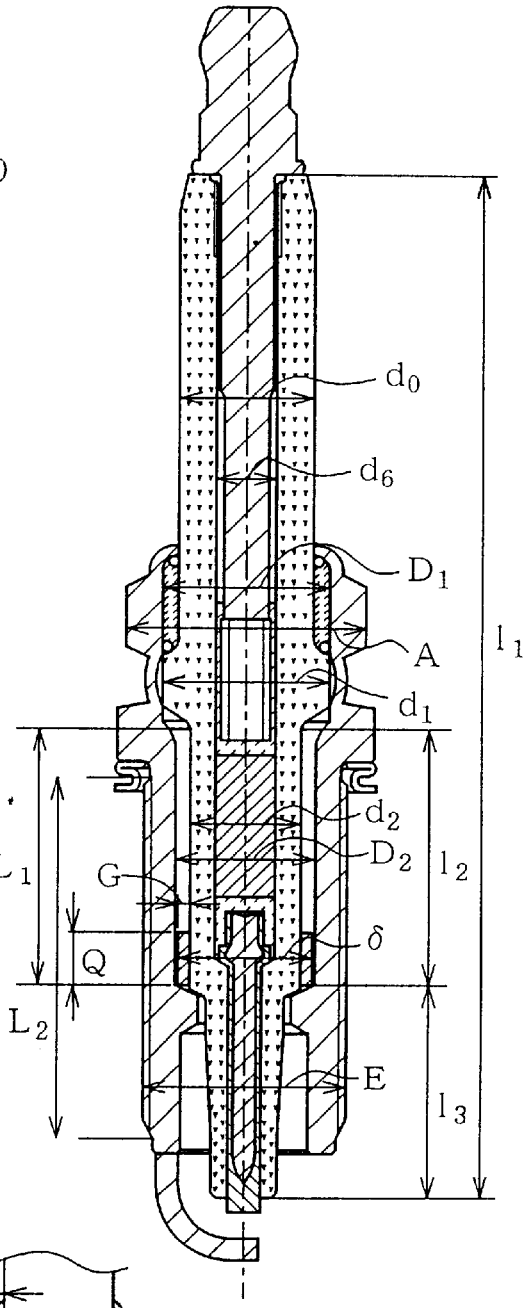
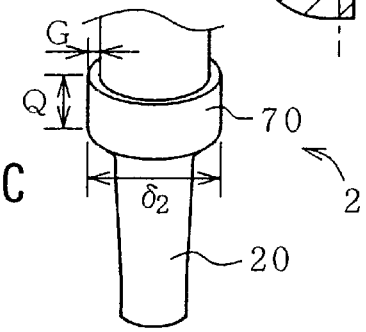
FIG. 4C

FIG. 8

| $d_2 / d_1$ | 0. 6 | 0. 65 | 0. 7 | 0. 75 | 0. 8 | 0. 85 | 0. 9 | 0. 95 |
|---|---|---|---|---|---|---|---|---|
| GLASS SEAL PRODUCTIVITY | ○ | ○ | ○ | ○ | × | × | × | × |

SPARK PLUG

CROSS REFERENCE TO RELATED APPLICATION

The present application claims foreign priority from Japanese Patent Application No. Hei 11-015679, filed on Jan. 25, 1999, the content of which is incorporated herein by reference in its entirety.

BACKGROUND OF THE INVENTION

1. Field of the Invention

The present invention relates to a spark plug used for ignition in an internal combustion engine.

2. Description of the Related Art

FIG. 9 shows a conventional spark plug 300 used for ignition in an internal combustion engine, such as an automobile gasoline engine. The spark plug 300 is mounted on a cylinder head SH of an engine by a male-threaded portion 301*a* formed on an outer circumferential surface of a metallic shell 301. When the spark plug 300 is mounted on the cylinder head SH, a spark discharge gap g defined by a ground electrode 304 and a center electrode 303 is positioned within a combustion chamber BR and is adapted to ignite a fuel-air mixture. A hexagonal portion 305 (tool engagement portion) is formed on an outer circumferential surface of the metallic shell 301 and is adapted to tighten the male-threaded portion 301*a* by a tightening tool. The metallic shell 301 assumes a substantially cylindrical shape having a bore 306 for receiving an insulator 302 and is conventionally manufactured by cold plastic processing and machining. In many spark plugs, in order to improve manufacturing efficiency, a schematic profile and the bore 306 are formed by die forging, and a final profile including the male-threaded portion 301*a* is finished by machining. Since the metallic shell 301 has a thin-walled portion, the dimensions of the metallic shell 301 must be designed in consideration of a material flow during die forging; otherwise, a working defect is likely to occur.

With a recent tendency toward complication of engine head structure, space allocated around a valve for installation of the spark plug 300 is decreasing. Thus, the hexagonal portion 305 needs to be reduced to increase space for use on the head side. However, reducing the size of the hexagonal portion 305 causes the following problems.

(1) To prevent an excessive reduction in the wall thickness of the hexagonal portion 305 in association with a reduction in the size of the hexagonal portion 305, a diameter $D_1$ of a portion (hereinafter referred to as "a major-bore portion") 306*a* of the shell bore 306 must be reduced. Also, the outside diameter of the insulator 302 must be reduced accordingly. However, when a diameter $D_2$ of a portion (hereinafter referred to as "an intermediate-bore portion") of the shell bore 306 corresponding to the male-threaded portion 301*a* is reduced, a forging punch becomes excessively thin, when the intermediate-bore portion 306*b* is formed by forging and thus may be damaged or may cause a working defect when a large working load is applied thereon. This problem arises particularly in the case when the male-threaded portion 301*a* has a long screw reach.

(2) A portion of the insulator 302 positioned within the major-bore portion 306*a* is formed into a flange portion 302*e*. When the metallic shell 306 is swaged onto the insulator 302, the flange portion 302*e* bears a swaging force. A metallic terminal 313 and a center electrode 303 are connected by a glass seal portion 315. In the step of the glass seal portion 315, the flange portion 302*e* bears a pressing force. In particular, the center electrode 303, a material powder of the glass seal portion 315, and the metallic terminal 313 are disposed within a through-hole formed in the insulator 302. Then the insulator 302 is inserted into a bore formed in a seat die such that the flange portion 302*e* rests on an inner seat portion formed on the wall of the bore. In this state, the entire insulator 302 is heated to a temperature equal to or higher than a glass softening point, and the metallic terminal 313 is pressed inwardly in the axial direction to press the material powder with the center electrode 303, thereby forming the glass seal portion 315. During this pressing process, the flange portion 302*e* bears a pressing force.

If the outside diameter of the insulator 302 is too small to meet the demand described above in (1), manufacturing the insulator 302 becomes very difficult. Therefore, there is a certain limit to a reduction in the outside diameter of the insulator 302. As the size of the hexagonal portion 305 is reduced, the diameter $D_1$ of the major-bore portion 306*a* is reduced accordingly. Thus, the diameter of the flange portion 302*e*, which is accommodated within the major-bore portion 306*a*, is also reduced. Because of a reduction in the size of the hexagonal portion 305, the diameter of the flange portion 302*e* must be reduced because there is a certain limit to a reduction in the diameter of a portion of the insulator 302 other than the flange portion 302*e* (for example, a portion of the insulator 302 positioned within the intermediate-bore portion 306*b*; hereinafter referred to as "an intermediate-trunk portion 302*a*"). As a result, the amount of a projection of the flange portion 302*e* decreases, causing, for example, a decrease in the area of contact between the flange portion 302*e* and the seat portion of the seat die used in the step of forming the glass seal portion 315. Consequently, a load concentration causes breakage of the seat die or galling of the insulator 302 and the seat die.

(3) If the diameter of the intermediate-trunk portion 302*a* of the insulator 302 is reduced to meet the demand described above in (2), and also the diameter $D_2$ of the intermediate-bore portion 306*b* of the metallic shell 306 is set to a rather large value to attain favorable workability during the process in (1), a gap is likely to be formed between the intermediate-bore portion 306*b* and the intermediate-trunk portion 302*a* of the insulator 302. The presence of this gap tends to cause an eccentric disposition of the insulator 302 within the metallic shell 301, potentially causing an impairment in spark plug performance (for example, lateral sparking).

SUMMARY OF THE INVENTION

An object of the present invention is to provide a spark plug capable of increasing the degree of freedom with respect to space around a cylinder head on which the spark plug is mounted, through reduction in the size of a tool engagement portion, such as a hexagonal portion, and capable of implementing the following:

(1) in spite of a reduction in the size of the tool engagement portion, a metallic shell can be manufactured efficiently and at high yield;

(2) during formation of a conductive glass seal layer or a resistor by use of a seat die, breakage or galling of the seat die is less likely to occur; and (3) during incorporation of an insulator into the metallic shell, an eccentric disposition of the insulator within the metallic shell is less likely to occur.

To achieve the above object, the present invention provides a spark plug including an elongate center electrode, an insulator enclosing the center electrode, a metallic shell having open opposite ends and enclosing the insulator, the metallic shell having a male-threaded portion formed on a front-side outer circumferential surface of the metallic shell, and a tool engagement portion formed on the outer circumferential surface of the metallic shell at a rear side with respect to the male-threaded portion, the tool engagement portion projecting circumferentially outwardly, and a ground electrode connected to the metallic shell and defining a spark discharge gap in cooperation with the center electrode.

In the specification, the term "front" refers to a spark discharge gap side with respect to an axial direction of the center electrode, and the term "rear" refers to a side opposite the front side.

The insulator has a stepped annular insulator-side engagement portion for engaging with an annular shell-side engagement portion projected inwardly from a portion of an inner surface of the metallic shell corresponding to the male-threaded portion, and $|A-E| \leqq 1.5$ mm, and $0.4 \leqq (D_2/E)^2 \leqq 0.6$, where A is a dimension of the tool engagement portion represented by a diameter of an inscribed circle of a cross-sectional outline of the tool engagement portion, E is an effective diameter of the male-threaded portion, and $D_2$ is an inner diameter of an intermediate-bore portion of the metallic shell located on a rear side with respect to the shell-side engagement portion.

According to the above-described structure, the dimension A of the tool engagement portion (for example, a hexagonal portion) is reduced with respect to the effective diameter E of the male-threaded portion such that $|A-E|$ becomes not greater than 1.5 mm. Thus, the degree of freedom with respect to space around a cylinder head on which the spark plug is mounted can be increased. Even when available space around a valve for installation of the spark plug decreases due to complication of cylinder head structure, the spark plug can be easily mounted on the cylinder head. Although the outside diameter of the insulator decreases in association with a reduction in the size of the tool engagement portion, so long as $0.4 \leqq (D_2/E)^2 \leqq 0.6$, the wall thickness of the male-threaded portion of the metallic shell falls within an appropriate range. Thus, during forging of the metallic shell, a forging punch is less susceptible to breakage and is less likely to cause a working defect. That is, the problem described previously in (1) is solved, and the metallic shell can be manufactured efficiently and at high yield.

More particularly, $(D_2/E)^2$ represents the ratio of the cross-sectional area of the intermediate-bore portion having the diameter $D_2$ "$\pi(D_2/2)^2$" to the cross-sectional area of the male-threaded portion having the effective diameter E "$\pi(E/2)^2$." The smaller the value $(D_2/E)^2$ (i.e., the more the effective diameter E of the male-threaded portion increases with respect to the diameter $D_2$ of the intermediate-bore portion), the greater the wall thickness of the male-threaded portion. When $(D_2/E)^2$ is less than 0.4, the wall thickness of the male-threaded portion becomes excessively large, causing an insufficient diameter of the intermediate-bore portion. As a result, when the intermediate-bore portion is to be formed through cold working, such as forging, a forging punch to be used becomes excessively thin and thus may be damaged or may cause a working defect when a large working load is imposed thereon. When $(D_2/E)^2$ is in excess of 0.6, the wall thickness of the male-threaded portion becomes excessively thin. As a result, formation of the male-threaded portion through cold working becomes difficult, and the formed male-threaded portion suffers insufficient strength. More preferably, $(D_2/E)^2$ ranges from 0.45 to 0.55.

A flange portion may be formed on the outer circumferential surface of the insulator on the rear side with respect to the stepped portion. In this case, preferably, $d_2/d_1$ is not greater than 0.75, where $d_1$ is the outside diameter of the flange portion, and $d_2$ is the outside diameter of an intermediate-trunk portion extending between the flange portion and the stepped portion. As mentioned previously in (2), in the case of reducing the outside dimension A of the tool engagement portion such that $|A-E|$ is not greater than 1.5 mm, if the outside diameter of the intermediate-trunk portion becomes excessively small, manufacture of the insulator becomes very difficult. Also, a reduction in the size of the tool engagement portion unavoidably requires a reduction in the outside diameter of the flange portion. In other words, the diameter ratio $d_2/d_1$ between the intermediate-trunk portion and the flange portion tends to increase. As $d_2/d_1$ increases, the amount of projection of the flange portion from the outer circumferential surface of the intermediate-trunk portion decreases. As a result, as mentioned previously, the step of forming a glass seal portion is likely to involve breakage of a seat die or galling between the insulator and the seat die. Through employment of a $d_2/d_1$ of not greater than 0.7, the amount of projection of the flange portion becomes sufficiently large, thereby effectively preventing the above-mentioned problem associated with a reduction in the size of the tool engagement portion; i.e., solving the problem described previously in (2). More preferably, $d_2/d_1$ is not greater than 0.65. However, $d_2/d_1$ is excessively small, the intermediate-trunk portion becomes too thin for manufacture of the insulator. Therefore, in order to avoid such a problem, the value $d_2/d_1$ must be adjusted as adequate.

As mentioned previously in (3), if the diameter of the intermediate-bore portion is set to a rather large value in order to attain favorable workability of the metallic shell while the diameter of the intermediate-trunk portion of the insulator is decreased in association with a reduction in the size of the tool engagement portion, a gap is likely to be formed between the intermediate-bore portion of the metallic shell and the intermediate-trunk portion of the insulator. In the case of formation of such a gap, preferably, an eccentricity preventive portion is provided substantially concentrically with the intermediate-bore portion and the intermediate-trunk portion in such a manner as to partially fill the gap. In the step of incorporating the insulator into the metallic shell, the eccentricity preventive portion restricts lateral movement of the insulator; i.e., an eccentric disposition of the insulator within the metallic shell, thereby solving the problem described previously in (3).

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

FIG. 4A is a cross-sectional view showing a spark plug similar to that of FIG. 1A except that an insulator-side eccentricity preventive projection is formed;

FIG. 4B is a cross-sectional view showing a dimensional definition with respect to the spark plug of FIG. 4A;

FIG. 4C is a perspective view showing the insulator-side eccentricity preventive projection;

FIG. 8 is a table showing the test results with respect to example 3; and

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to the same or like parts.

In accordance with the invention, a spark plug including an insulator having a center through-hole formed therein, a center electrode held in the center through-hole, a metallic shell holding the insulator by swaging, and a ground electrode electrically connected to the metallic shell and defining a spark discharge gap in cooperation with the center electrode. The metallic shell has a male-threaded portion formed on the outer circumferential surface of a front end portion of the metallic shell, and a tightening portion formed on the outer circumferential surface of the metallic shell, located at a rear side with respect to the male-threaded portion. The distance between two opposed parallel surfaces of the tightening portion is not greater than 14 mm ($W \leqq 14.0$ mm). A cushion material is charged into a cylindrical space defined by an outer surface of the insulator and an inner surface of the metallic shell to form a cushion-material charged portion. The cushion-material charged portion has an axial length L of from 0.5 mm to 10.0 mm inclusive (0.5 mm $\leqq L \leqq$ 10.0 mm) and a thickness M of from 0.5 mm to 1.3 mm inclusive (0.5 mm $\leqq M \leqq$ 1.3 mm).

Figure 1A:
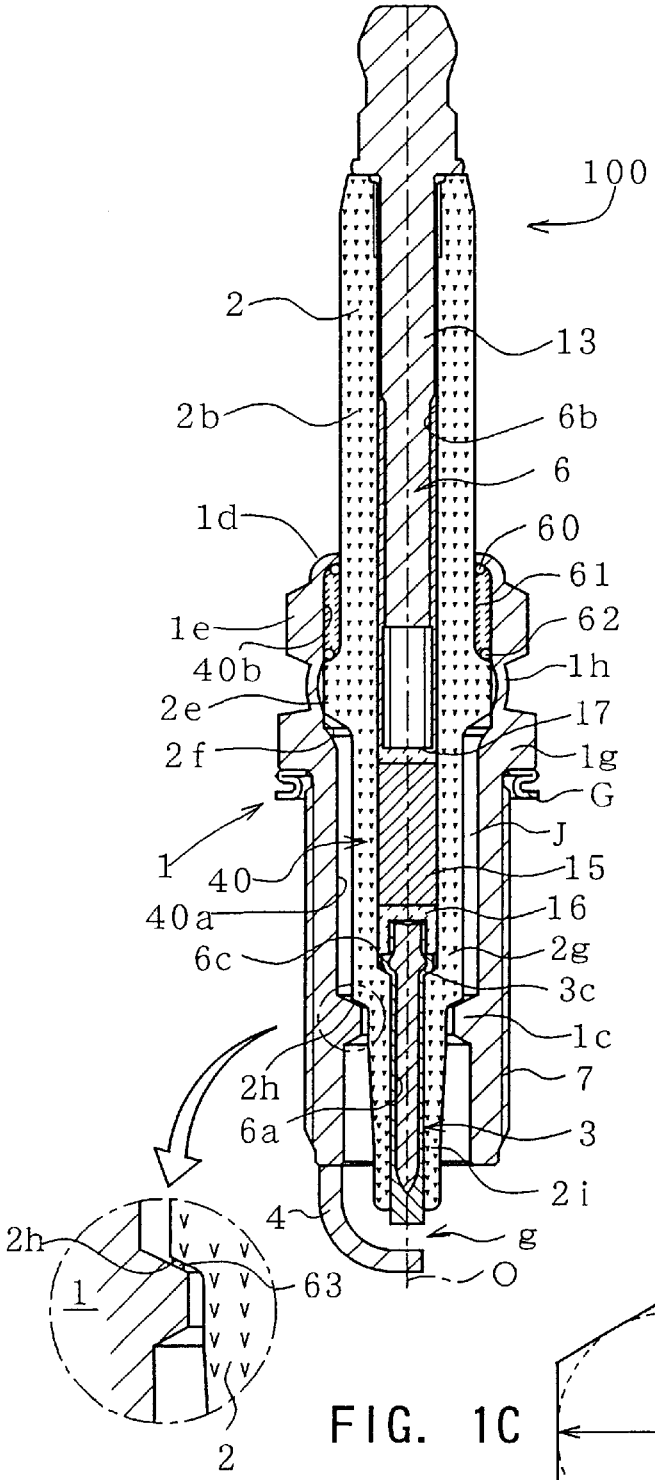
FIG. 1A is a cross-sectional view showing a spark plug according to an embodiment of the present invention.
Figure 1B:
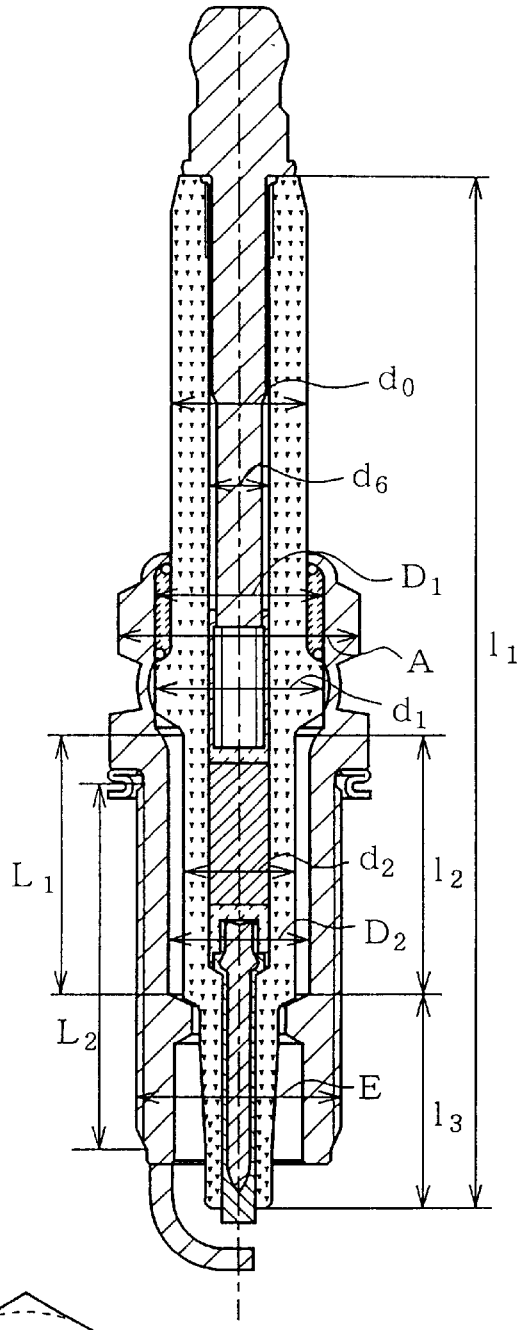
FIG. 1B is a cross-sectional view showing a dimensional definition with respect to the spark plug of FIG. 1A.

Referring to FIGS. 1A and 1B, a spark plug 100 includes a metallic shell 1, an insulator 2, a center electrode 3, and a ground electrode 4. The metallic shell 1 assumes a substantially cylindrical shape. The insulator 2 is fitted into the metallic shell 1 such that a tip portion 2i is projected from the metallic shell 1. The center electrode 3 is disposed within the insulator 2 such that a tip portion is projected from the insulator 2. One end of the ground electrode 4 is connected to the metallic shell 1 by, for example, welding. A spark discharge gap g is defined by the ground electrode 4 and the center electrode 3. Hereinafter, the term "front" refers to the side of the spark discharge gap g with respect to the axial direction of the center electrode 3, and the term "rear" refers to a side opposite the front side.

A through-hole 6 is formed axially in the insulator 2. A metallic terminal 13 is inserted into the through-hole 6 from the rear end and is fixed therein. Similarly, a center electrode 3 is inserted into the through-hole 6 from the front end and is fixed therein. A resistor is disposed within the through-hole 6 and between the metallic terminal 13 and the center electrode 3. The opposite ends of the resistor 15 are electrically connected to the center electrode 3 and the metallic terminal 13 via conductive glass seal layers 16 and 17, respectively. The resistor 15 is formed from a resistor composition that is obtained by the steps of mixing glass powder and conductive-material powder (and, as needed, ceramic powder other than glass) and sintering the resultant mixture by for example, a hot press. Alternatively, the resistor 15 may be omitted, and the metallic terminal 13 and the center electrode 3 may be integrated by a single conductive glass seal layer.

The insulator 2 is formed from an insulating material, such as alumina or aluminum nitride (AlN). The insulator 2 has a flange portion 2*e* that is formed in an axially intermediate position and projects outwardly circumferentially. The insulator 2 includes a main-body portion 2*b*, which is located on the rear side with respect to the flange portion 2*e* and has a diameter smaller than that of the flange portion 2*e*. The insulator 2 further includes an intermediate-trunk portion 2*g*, which is located on the front side with respect to the flange portion 2*e* and has a diameter smaller than that of the flange portion 2*e*, and a tip portion 2*i*, which is located on the front side with respect to the intermediate-trunk portion 2*g* and has a diameter smaller than that of the intermediate-trunk portion 2*g*. A boundary portion between the flange portion 2*e* and the intermediate-trunk portion 2*g* is formed into a stepped portion 2*f*. The intermediate-trunk portion 2*g* assumes a substantially cylindrical shape. The outside diameter of the tip portion 2*i* is reduced toward an end of the tip portion 2*i* such that the tip portion 2*i* assumes substantially a truncated cone shape.

The metallic shell 1 is made of a ferrous material suited for cold working, such as low-carbon steel or carbon steel wires for cold heading and cold forging specified in JIS G 3539, and serves as a housing for the spark plug 100. Carbon steel wires for cold heading and cold forging specified in JIS G 3539 and applicable favorably to the present invention include SWCH8A (C: $\leqq$0.10; Si: $\leqq$0.10; Mn: $\leqq$0.60; Al: $\leqq$0.02; balance: Fe (unit: weight %)); SWCH17K (C: 0.15–0.20; Si: 0.10–0.35; Mn: 0.30–0.60; balance: Fe (unit: weight %)); and SWCH25K (C: 0.22–0.28; Si: 0.10–0.35; Mn: 0.30–0.60; balance: Fe (unit: weight %)).

Figure 1C:
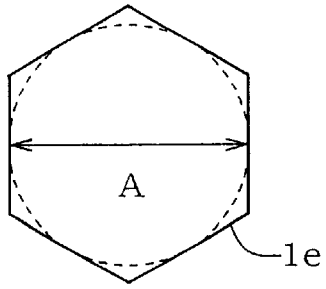
FIG. 1C is a schematic transverse cross-sectional view showing a tool engagement portion of the spark plug of FIG. 1A.

A male-threaded portion 7 is formed on the front side, outer circumferential surface of the metallic shell 1 and is adapted to attach the spark plug 100 to an engine block. A ring-shaped gasket G is fitted to a root of the male-threaded portion 7. A flange-shaped gas seal portion 1g is formed on an outer circumferential surface of the metallic shell 1 on the rear side with respect to the male-threaded portion 7 and projects circumferentially outward. A thin-walled connection portion 1*h* is located on the rear side with respect to the gas seal portion 1*g*. A tool engagement portion 1*e* is formed on the metallic shell 1 on the rear side with respect to the connection portion 1*h* and projects circumferentially outward. The tool engagement portion 1*e* is adapted to engage with a tool, such as a spanner or a wrench, to tighten the male-threaded portion 7 into a female-threaded hole formed in a cylinder head for attachment of the spark plug 100 to the cylinder head. As shown in FIG. 1C, the tool engagement portion 1*e* has a substantially hexagonal cross section. The spark plug 100 attached to the cylinder head is used to ignite a fuel-air mixture supplied into a combustion chamber. When the spark plug 100 is attached to the cylinder head as described above, the gasket G is compressed and deformed between the gas seal portion 1*g* and a circumferential edge portion of the female-threaded hole to thereby seal the female-threaded hole and the male-threaded portion 7 against each other.

A bore 40 is formed axially in the metallic shell 1 to receive the insulator 2. A circumferential projection 1*c* (shell-side engagement portion) is formed on a portion of the wall surface of the bore 40 corresponding to the male-threaded portion 7 and is located in a frontward intermediate position. A portion of the bore 40 that extends rearward from the projection 1*c* serves as an intermediate-bore portion 40*a* for accommodating the intermediate-trunk portion 2*g* of the insulator 2. The intermediate-bore portion 40*a* is merged into a major-bore portion 40*b* having a diameter greater than that of the intermediate-bore portion 40*a* via a stepped portion formed at the rear end thereof. The major-bore portion 40*b* accommodates the flange portion 2*e*.

The outside diameter of the center electrode 3 is smaller than that of the resistor 15. The through-hole 6 formed in the insulator 2 includes a substantially cylindrical first portion 6*a* for receiving the center electrode 3 and a substantially cylindrical second portion 6*b* located on the rear side with respect to the first portion 6*a* and having a diameter greater than that of the first portion 6*a*. As shown in FIG. 1A, the metallic terminal 13 and the resistor 15 are accommodated within the second portion 6*b*, and the center electrode 3 is inserted into the first portion 6*a*. An electrode fixation projection 3*c* is formed on a rear end portion of the center electrode 3 and circumferentially projects outwardly from the outer circumferential surface of the center electrode 3. The first portion 6*a* and the second portion 6*b* are connected within the intermediate-trunk portion 2*g*, via a tapered or radiused seat surface 6*c* permitting the electrode fixation projection 3*c* to rest thereon.

The insulator 2 has a stepped portion 2*h* formed between the intermediate-trunk portion 2*g* and the tip portion 2*i*. Serving as the insulator-side engagement portion, the stepped portion 2*h* engages with the projection 1*c* of the metallic shell 1, or the shell-side engagement portion, via a ring-shaped sheet packing 63. In this manner, the insulator 2 is prevented from axially slipping through the metallic shell 1. In a space defined by the outer surface of the insulator and the inner wall of a rear-end opening portion of the metallic shell 1, a ring-shaped wire packing 62 is fitted to a rear-end face of the flange portion 2*e*. A filler layer 61, such as talc, is disposed on the rear side with respect to the wire packing 62. A ring-shaped packing 60 is disposed on the rear side with respect to the filler layer 61. While the insulator 2 fitted into the metallic shell 1 is pressed toward the front side, a rear opening edge of the metallic shell 1 is swaged inward and toward the packing 60, thereby forming a swaged portion 1*d* and thus fixedly integrating the metallic shell 1 and the insulator 2 into a single unit.

Next, dimensional conditions of the spark plug 100 will be described. $|A-E|$ is not greater than 1.5 mm, where A is a dimension of the tool engagement portion 1*e* represented by the diameter of an inscribed circle of a cross-sectional outline of the tool engagement portion 1*e* as shown in FIGS. 1C, and E is the effective diameter of the male-threaded portion 7 as shown in FIG. 1B (i.e., the size of the tool engagement portion 1*e* is reduced such that the difference between the outside dimension A of the tool engagement portion 1*e* and the effective diameter E of the male-threaded portion 7 is not greater than 1.5 mm). Also, $(D_2/E)^2$ ranges from 0.4 to 0.6 inclusive (preferably $0.45 \leqq (D_2/E)^2 \leqq 0.55$), where $D_2$ is the diameter of the intermediate-bore portion 40*a* of the metallic shell 1. Further, $d_2/d_1$ is not greater than 0.75 (preferably $0.65 \geqq d_2/d_1$), where $d_1$ is the outside diameter of the flange portion 2*e* of the insulator 2, and $d_2$ is the outside diameter of the intermediate-trunk portion 2*g* of the insulator 2.

More particularly, dimensions of the spark plug 100 are adjusted to the following ranges (parenthesized values are of a tested spark plug of FIG. 1).

- Overall length of insulator 2, $I_1$: 45 to 100 mm (69 mm)
- Length of intermediate-trunk portion 2*g*, $I_2$: 3 to 28 mm (18 mm)
- Length of tip portion 2*i*, $I_3$: 3 to 25 mm (14 mm)
- Outside diameter of main-body portion 2*b*, d0: 5 to 12 mm (9 mm)
- Outside diameter of flange portion 2*e*, $d_1$: 6 to 13 mm (11.3 mm)
- Outside diameter of intermediate-trunk portion 2*g*, $d_2$: 4.5 to 10 mm (7.3 mm)
- Outside dimension of tool engagement portion 1*e*, A: 5.5 to 15.5 mm (14 mm)
- Diameter of intermediate-bore portion 40*a*, $D_2$: 4.5 to 11 mm (9.5 mm)
- Length of intermediate-bore portion 40*a*, $L_1$: 3 to 28 mm (17 mm)
- Diameter of major-bore portion 40*b*, $D_1$: 6.1 to 13.5 mm (1 3.06 mm)
- Effective diameter of male-threaded portion 7, E: 7 to 14 mm (14 mm)
- Screw reach of male-threaded portion 7, $L_2$: 10 to 27 mm (24.5 mm)

In manufacture of the metallic shell 1, a material wire as specified in, for example, JIS G 3539 "Carbon Steel Wires for Cold Heading and Cold Forging" is cut into rods, each having a predetermined length. The rod is die-forged and assumes a rough profile and has the bore 40 therein. The resulting workpiece undergoes form rolling to form the male-threaded portion 7 thereon, followed by finishing work to yield the metallic shell 1.

Figure 5A:
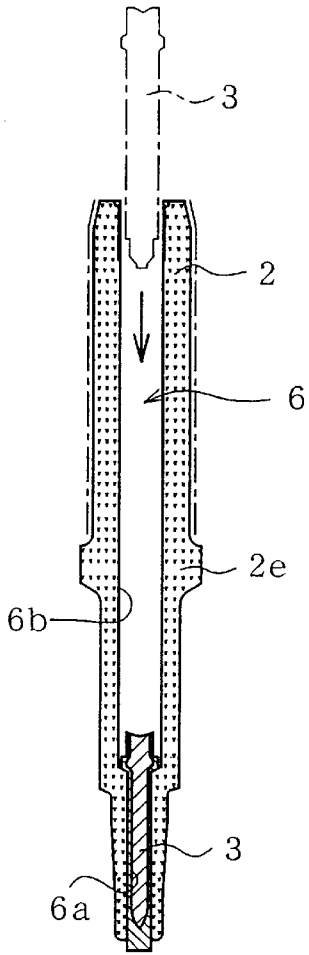
FIGS. 5A–5D, and 6(A) and (B) illustrate a glass seal step.
Figure 5B:
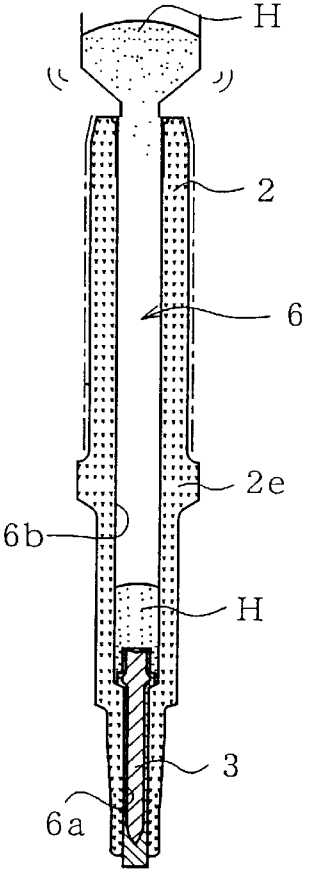
Figure 5C:
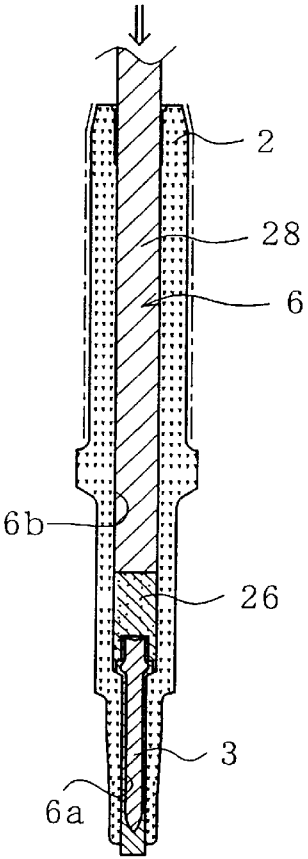
Figure 5D:
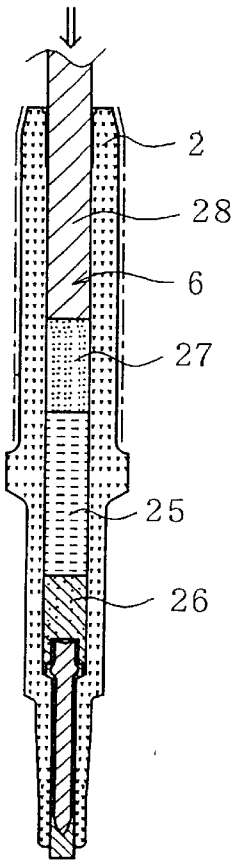

Next, the step of attaching the center electrode 3 and the metallic terminal 13 to the insulator 2 and forming the resistor 15 and the conductive glass seal layers 16 and 17 (hereinafter referred to as a glass seal step) will be described briefly. As shown in FIG. 5A, the center electrode 3 is inserted into the first portion 6*a* of the through-hole 6 formed in the insulator 2. Subsequently, as shown in FIG. 5B, a conductive glass powder H is placed in the through-hole 6. Then, as shown in FIG. 5C, a presser bar 28 is inserted into the through-hole 6 so as to preliminarily compress the powder H, thereby forming a first conductive glass powder layer 26. Next, a resistor composition powder is placed in the through-hole 6 and undergoes preliminary compression in a similar manner, thereby forming a resistor composition powder layer 25. Further, a conductive glass powder is placed in the through-hole 6, followed by similar preliminary compression to thereby form a second conductive glass powder layer 27. As a result, as shown in FIG. 5D, the first conductive glass powder layer 26, the resistor composition powder layer 25, and the second conductive glass powder layer 27 are arranged in layers on the center electrode 3.

FIG. 6(A) shows an assembly PA of the metallic terminal 13 and the insulator 2, in which the metallic terminal 13 is inserted into the through-hole 6 of the insulator 2. The insulator 2 is inserted into a through-hole Sa formed in a seat die S so that the flange portion 2*e* rests on an edge portion of the through-hole Sa. The assembly PA is placed in a furnace and is heated to a predetermined temperature of 900° C. to 1000° C. (an average temperature of the entire assembly PA), which is equal to or higher than a glass softening point. Subsequently, the metallic terminal 13 is pressed further into the through-hole 6 to thereby axially press the layers 26, 25, and 27. As a result, as shown in FIG. 6(B), the layers 26, 25, and 27 are compressed and sintered to thereby become the conductive glass seal layer 16, the resistor 15, and the conductive glass seal layer 17, respectively. In this glass seal step, the flange portion 2*e* bears a force of the above pressing work.

As described previously, dimensional conditions of the present invention yield the following action and effect in the glass seal step. Through reduction of the outside dimension A of the tool engagement portion 1*e* such that $|A-E|$ becomes not greater than 1.5 mm, the degree of freedom with respect to space around a cylinder head can be increased. Through employment of $0.4 \leqq (D_2/E)^2 \leqq 0.6$, the wall thickness of the male-threaded portion 7 falls within an appropriate range. Thus, during forging of the metallic shell 1, a forging punch is less susceptible to breakage and is less likely to cause a working defect, so that the metallic shell 1 can be manufactured efficiently and at high yield. Through employment of a $d_2/d_1$ of not greater than 0.75, the amount of projection of the flange portion 2*e* becomes sufficiently large, whereby the glass seal step is less likely to involve breakage of the seat die S or galling between the insulator 2 and the seat die S which would otherwise results from load concentration. A wall thickness T of the male-threaded portion 7 can be represented by $(E-D_2)/2$. The male-threaded portion 7 may be designed from the viewpoint of the wall thickness T in the following manner. For example, in the case of $7\ \text{mm} \leqq E \leqq 14\ \text{mm}$ and $4.5\ \text{mm} \leqq D_2 \leqq 11\ \text{mm}$, $3\ \text{mm} \leqq (E-D_2) \leqq 5\ \text{mm}$ is preferred. If $(E-D_2)$ is less than 3 mm, the wall thickness T becomes too thin for formation of the male-threaded portion 7 through cold working. If $(E-D_2)$ is in excess of 5 mm, the wall thickness T becomes excessively large, causing an insufficient diameter $D_2$ of the intermediate-bore portion 40*a*. As a result, when the intermediate-bore portion 40*a* is to be formed through cold working, such as forging, a forging punch to be used becomes excessively thin and thus may be damaged or may cause a working defect when a large working load is imposed thereon. More preferably, $(E-D_2)$ ranges from 3.5 mm to 4.5 mm.

As the screw reach $L_2$ of the male-threaded portion 7 increases, the above-mentioned problem is more likely to occur. A lower limit of the ratio of the wall thickness T of the male-threaded portion 7 to the screw reach $L_2$; i.e., a lower limit of $T/L_2$ is adjusted so as to impart a sufficient wall thickness to the male-threaded portion 7 in order to prevent difficulty in forming the male-threaded portion 7 through cold working. An upper limit of $T/L_2$ is adjusted so as to prevent the problem in that, when the intermediate-bore portion 40*a* is to be formed through cold working, such as forging, a forging punch to be used becomes excessively thin and thus may be damaged or may cause a working defect when a large working load is imposed thereon.

The amount of projection of the flange portion 2*e* from the outer circumferential surface of the intermediate-trunk portion 2*g* is represented by $(d_1-d_2)$, where $d_1$ is the outside diameter of the flange portion 2*e*, and $d_2$ is the outside diameter of the intermediate-trunk portion 2*g*. In the case of $6\ \text{mm} \leqq d_1 \leqq 13\ \text{mm}$ and $4.5\ \text{mm} \leqq d_2 \leqq 10\ \text{mm}$, $1.5\ \text{mm} \leqq (d_1-d_2)$ is preferred. Through employment of $(d_1-d_2)$ not less than 1.5 mm, the amount of projection of the flange portion 2*e* becomes sufficiently large, thereby effectively preventing the aforementioned problem which would otherwise arise in association with a reduction in the size of the tool engagement portion 1*e*. Notably, the radio $d_2/d_1$ is adjusted as appropriate in order to prevent the problem in that the intermediate-trunk portion 2*g* becomes too thin for manufacture of the insulator 2. More preferably, $(d_1-d_2)$ is not less than 2 mm.

If the diameter $D_2$ of the intermediate-bore portion 40*a* is set to a rather large value to attain favorable workability of the metallic shell 1. In particular, to attain favorable durability of a forging punch while the diameter of the intermediate-trunk portion 2*g* of the insulator 2 is decreased in association with a reduction in the size of the tool engagement portion 1*e*, a gap J is likely to be formed between the wall of the intermediate-bore portion 40*a* and the outer surface of the intermediate-trunk portion 2*g*. In this case, an eccentricity preventive portion is provided substantially concentrically with the intermediate-bore portion 40*a* and the intermediate-trunk portion 2*g* in such a manner as to partially fill the gap J, thereby preventing an eccentric disposition of the insulator 2 within the metallic shell 1. Examples of the eccentricity preventive portion will next be described.

Figure 2A:
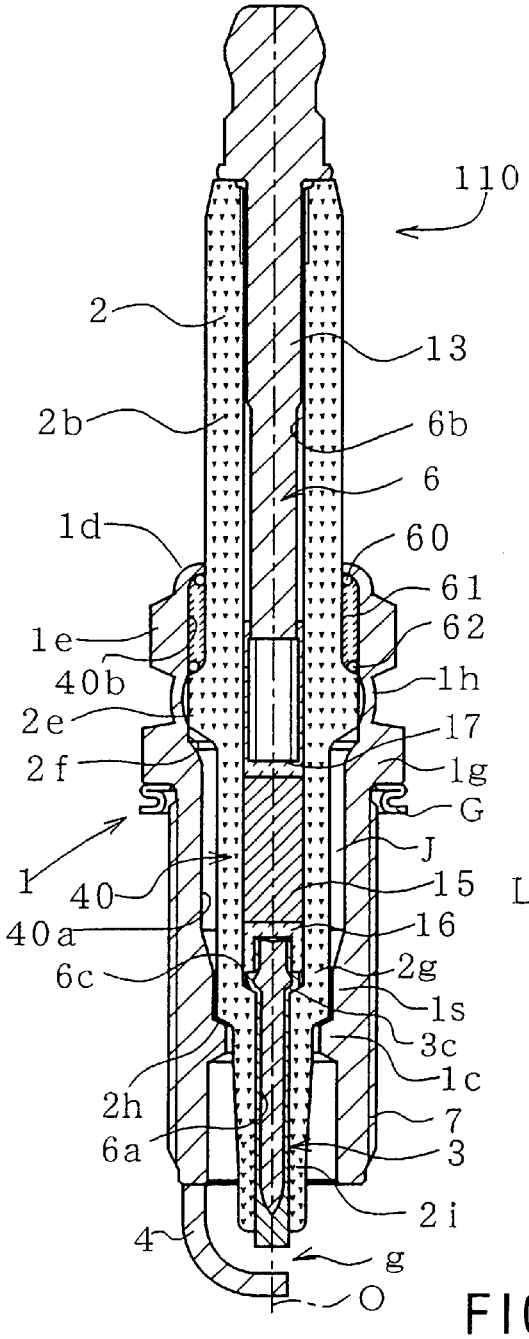
FIG. 2A is a cross-sectional view showing a spark plug similar to that of FIG. 1A except that a shell-side eccentricity preventive projection is formed.
Figure 2B:
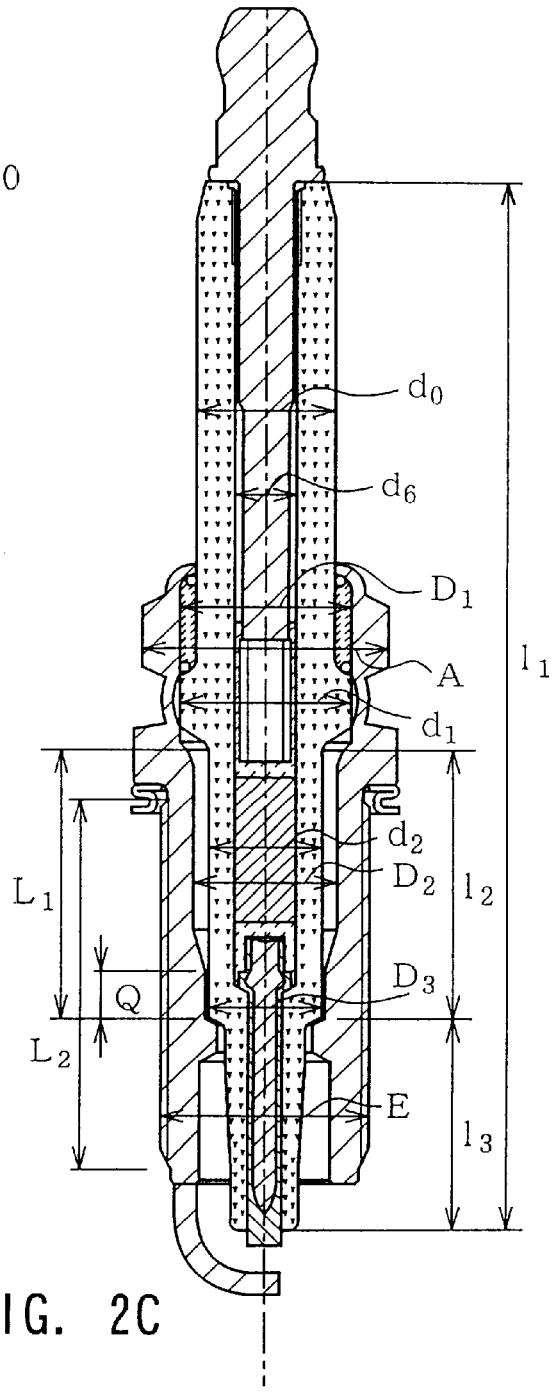
FIG. 2B is a cross-sectional view showing a dimensional definition with respect to the spark plug of FIG. 2A.
Figure 2C:
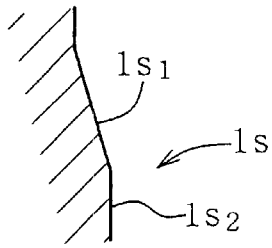
FIG. 2C is a sectional view showing the shell-side eccentricity preventive projection.

FIGS. 2A and 2B show a spark plug 110 similar to that of FIGS. 1A and 1B except that a shell-side eccentricity preventive projection is serving as the eccentricity preventive portion is circumferentially formed on the wall of the intermediate-bore portion 40*a* (the same features as those of FIGS. 1A and 1B are denoted by common reference numerals, and their description is omitted). The shell-side eccentricity preventive projection 1*s* is formed continuously with a rear edge of the shell-side engagement portion 2*h* and annularly along the circumferential direction of the intermediate-bore portion 40*a*. An inner circumferential surface $1s_2$ of the shell-side eccentricity preventive projection 1*s* assumes a cylindrical surface corresponding to an outer circumferential surface of the intermediate-trunk portion 2*g*. As shown in FIG. 2C, the inner circumferential surface $1s_2$ and the wall surface of the intermediate-bore portion 40*a* are connected by means of a tapered connection surface $1s_1$. In the step of incorporating the insulator 2 into the metallic shell 1, the shell-side eccentricity preventive projection 1*s* restricts lateral movement of the insulator 2, thereby preventing an eccentric disposition of the insulator 2 within the metallic shell 1.

The shell-side eccentricity preventive projection 1*s* has a bore diameter $D_3$ and an axial length Q of the inner circumferential surface. Preferably, the shell-side eccentricity preventive projection 1*s* meets the following dimensional conditions: $0.96 \leqq d_2/D_3 < 1$, and $Q \geqq 1$ mm, where $d_2$ is the diameter of the intermediate-bore portion 40*a*. If $d_2/D_3$ is less than 0.95 or if Q is less than 1 mm, the effect of preventing lateral movement of the insulator 2 becomes insufficient. If $d_2/D_3$ is in excess of 1, the insertion of the intermediate-trunk portion 2*g* into the intermediate-bore portion 40*a* becomes difficult. The ratio $d_2/D_3$ is preferably 0.97 to 0.98. The length Q is preferably not less than 1.5 mm. If $Q/L_1$ (where $L_1$ is the axial length of the intermediate-bore portion 40*a* including the shell-side eccentricity preventive projection 1*s*) is in excess of 0.3, a similar result to that in the case where the wall thickness of the male-threaded portion 7 is increased will arise, causing an increased likelihood of breakage of a forging punch. Therefore, $Q/L_1$ is set to not greater than 0.3, preferably not greater than 0.2. Since a gap between the outer circumferential surface of the flange portion 2*e* and the wall of the major-bore portion 40*b* may also cause an eccentric disposition of the insulator 2, preferably, $d_1/D_1$ is also adjusted to a range of 0.96 to 1.

Figure 3A:
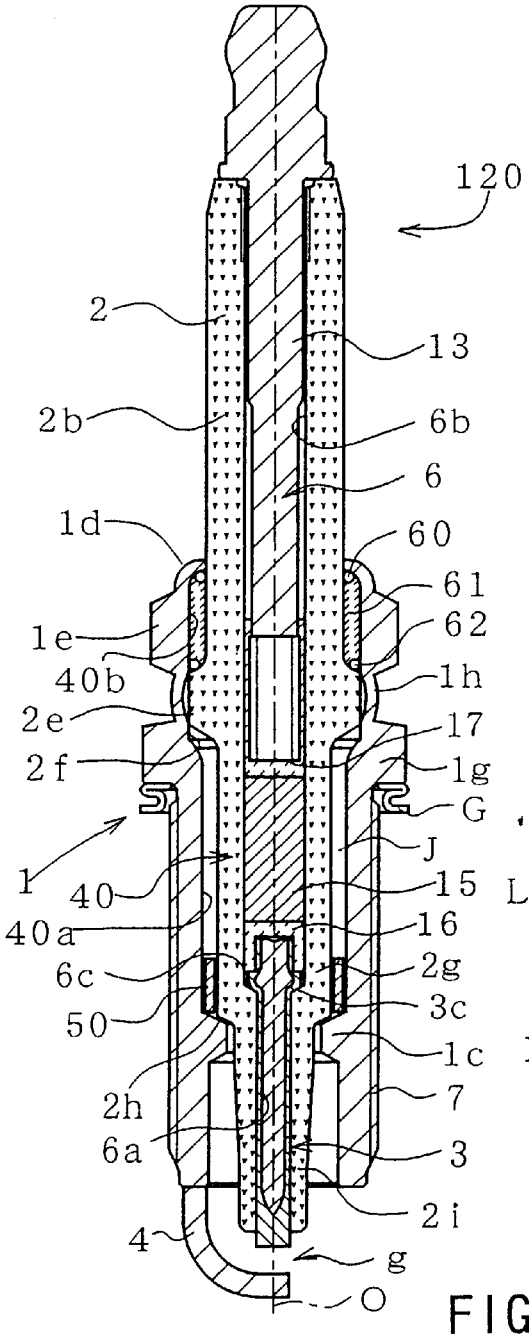
FIG. 3A is a cross-sectional view showing a spark plug similar to that of FIG. 1A except that an eccentricity preventive ring is disposed.
Figure 3B:
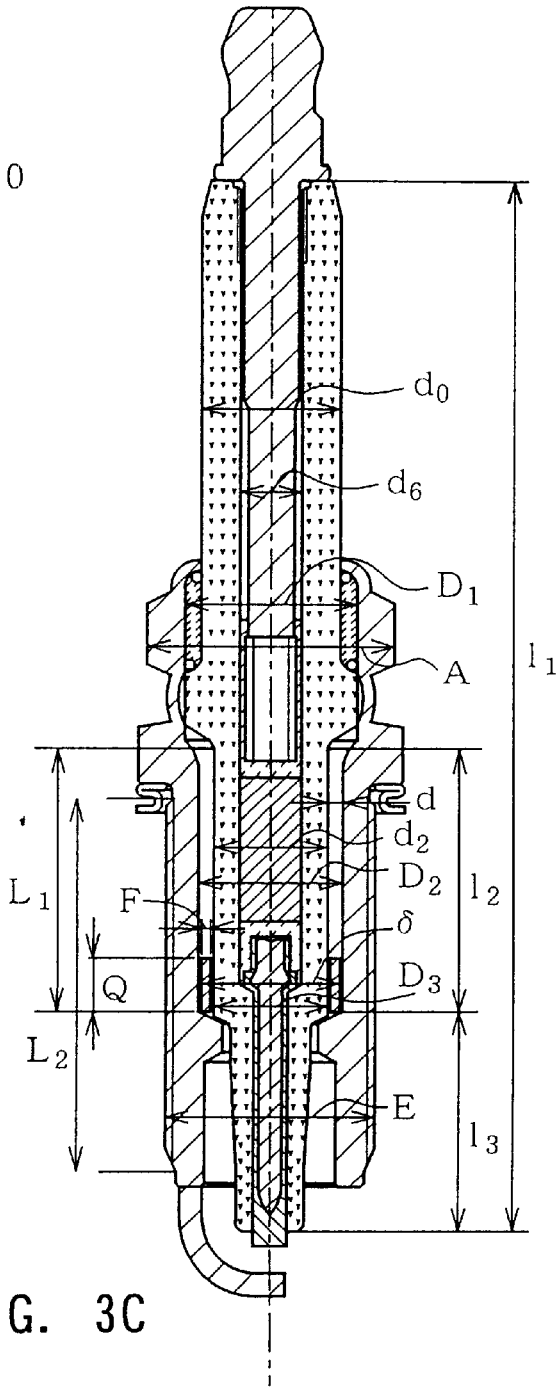
FIG. 3B is a cross-sectional view showing a dimensional definition with respect to the spark plug of FIG. 3A.

FIGS. 3A and 3B show a spark plug 120 similar to that of FIGS. 1A and 1B except that an eccentricity preventive ring 50 serving as the eccentricity preventive portion is disposed around the intermediate-trunk portion 2*g* of the insulator 2 (the same features as those of FIGS. 1A and 1B are denoted by common reference numerals, and their description is omitted). The eccentricity preventive ring 50 may be formed of, for example, plastic, hard rubber, metal, or ceramic. In attachment, the eccentricity preventive ring 50 may be inserted beforehand into the intermediate-bore portion 40*a* of the metallic shell 1. Then, the insulator 2 may be inserted into the eccentricity preventive ring 50. Alternatively, the eccentricity preventive ring 50 may be press-fitted beforehand to the insulator 2. Then, the thus-prepared insulator 2 may be inserted into the metallic shell 1.

Basically, the eccentricity preventive ring 50 produces an effect similar to that produced by the shell-side eccentricity preventive projection 1*s* of the spark plug 110 shown in FIGS. 2A and 2B. In contrast to the employment of the eccentricity preventive projection 1*s*, the employment of the eccentricity preventive ring 50 does not involve an increase in the wall thickness of the male-threaded portion 7 and is thus advantageous in terms of the workability of the metallic shell 1.

Figure 3C:
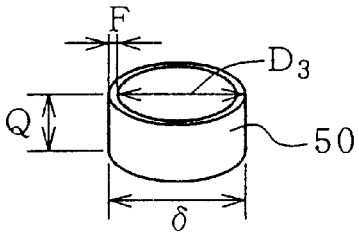
FIG. 3C is a perspective view showing the eccentricity preventive ring.

As shown in FIG. 3C, the eccentricity preventive ring 50 has an outside diameter δ, a bore diameter $D_3$, and an axial length Q. Preferably, the eccentricity preventive ring 50 meets the following dimensional conditions: $0.96 \leqq \delta/D_2 \leqq 1$, $0.96 \leqq d_2/D_3 \leqq 1$, and $Q \geqq 1$ mm. If $\delta/D_2$ or $d)D_3$ is less than 0.96 or if Q is less than 1 mm, the effect of preventing lateral movement of the insulator 2 becomes insufficient. If $\delta/D_2$ is in excess of 1, the insertion of the eccentricity preventive ring 50 into the intermediate-bore portion 40*a* becomes difficult. If $d_2/D_3$ is in excess of 1, the insertion of the intermediate-trunk portion 2*g* into the eccentricity preventive ring 50 becomes difficult (however, if the eccentricity preventive ring 50 is elastically deformable, even though at least either $\delta/D_2$ or $d_2/D_3$ is slightly greater than 1, no problem may arise). The ratios $\delta/D_2$ and $d_2/D_3$ are preferably 0.97 to 0.98. The length Q is preferably not less than 2 mm. Similarly, $0.95 \leqq F/d \leqq 1$, where F is the wall thickness of the eccentricity preventive ring 50, and d is the dimension of the gap J. As mentioned previously, since the disposition of the eccentricity preventive ring 50 has no effect on the workability of the metallic shell 1, Q may be lengthened substantially to the axial length $L_1$ of the intermediate-bore portion 40*a*.

FIGS. 4A and 4B show a spark plug 130 similar to that of FIGS. 1A and 1B except that an insulator-side eccentricity preventive projection 70 serving as the eccentricity preventive portion is disposed on the intermediate-trunk portion 2*g* of the insulator 2 (the same features as those of FIGS. 1A and 1B are denoted by common reference numerals, and their description is omitted). The insulator-side eccentricity preventive projection 70 is formed of plastic and is integrally fitted to the outer circumferential surface of the insulator 2 so as to assume an annular form as shown in FIG. 4C. After the glass seal step is completed, the insulator-side eccentricity preventive projection 70 may be formed on the outer circumferential surface of the insulator 2 by means of, for example, insert molding.

The insulator-side eccentricity preventive projection 70 also produces an effect similar to that produced by the shell-side eccentricity preventive projection 1*s* of the spark plug 110 shown in FIGS. 2A and 2B. The employment of the insulator-side eccentricity preventive projection 70 does not involve an increase in the wall thickness of the male-threaded portion 7 and is thus advantageous in terms of the workability of the metallic shell 1.

The insulator-side eccentricity preventive projection 70 has an outside diameter $\delta_2$ and an axial length Q. Preferably, the insulator-side eccentricity preventive projection 70 meets the following dimensional conditions: $0.96 \leqq \delta_2/D_2 \leqq 1$, and $Q \geqq 1$ mm. If $\delta_2/D_2$ is less than 0.96 or if Q is less than 1 mm, the effect of preventing lateral movement of the insulator 2 becomes insufficient. If $\delta_2/D_2$ is in excess of 1, the insertion of the insulator-side eccentricity preventive projection 70 into the intermediate-bore portion 40*a* becomes difficult (however, if the insulator-side eccentricity preventive projection 70 is elastically deformable, even though at least either $\delta_2/D_2$ is slightly greater than 1, no problem may arise). The ratio $\delta_2/D_2$ is preferably 0.97 to 0.98. The length Q is preferably not less than 2 mm. Similarly, $0.95 \leqq G/d \leqq 1$, where G is the height of the insulator-side eccentricity preventive projection 70, and d is the dimension of the gap J. The axial length Q may be lengthened substantially to the axial length $L_1$ of the intermediate-bore portion 40*a*.

EXAMPLES

Example 1

The metallic shells 1 of the spark plug shown in FIG. 1 were manufactured by use of SWCH8A specified in JIS G 3539 "Carbon Steel Wires for Cold Heading and Cold Forging" and through cold forging (the male-threaded portion 7 was formed through rolling). Dimensions of the metallic shell 1 were as follows:

Outside dimension of tool engagement portion 1*e*, A: 14 mm

Diameter of intermediate-bore portion 40*a*, $D_2$: (7) mm to (11) mm

Length of intermediate-bore portion 40*a*, $L_1$: 17 mm

Diameter of major-bore portion 40*b*, $D_1$: 13.06 mm

Effective diameter of male-threaded portion 7, E: 13.05 mm

Screw reach of male-threaded portion 7, $L_2$: 26.5 mm $0.3 \leqq (D_2/E)^2 \leqq 0.7$.

Figure 7A:
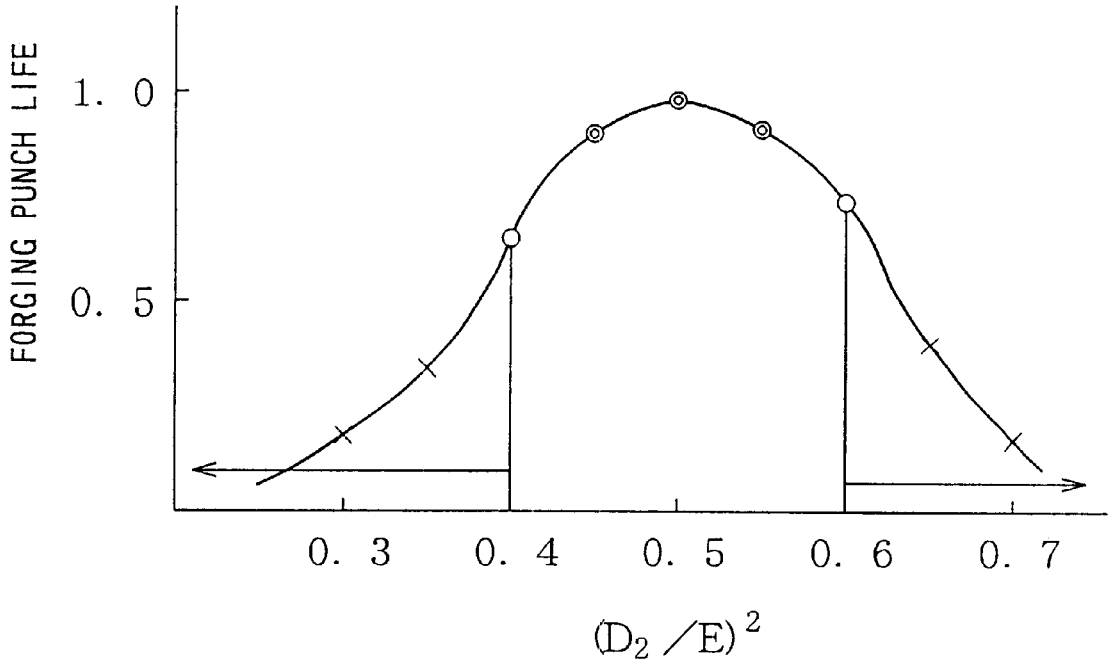
FIG. 7A is a graph showing the test results with respect to example 1.

The intermediate-bore portion 40*a* was formed through cold forging which was performed in 6 stages. A forging punch used in the sixth stage, which has the greatest area reduction rate, was tested for life with respect to various values of $(D_2/E)^2$. The life of the forging punch was evaluated in terms of the number of forging operations until $(D_2r-D_2a)$ became 0.05 mm or greater, where $D_2a$ is a target value of the diameter $D_2$ of the intermediate-bore portion 40*a*, and $D_2r$ is an actually obtained value of the diameter $D_2$. The test results are shown in FIG. 7A (the life of a forging punch is represented by a relative value, while that as measured when $(D_2/E)^2$ is 0.5 is take as 1.0). As seen from FIG. 7A, the forging punch life is elongated when $(D_2/E)^2$ ranges from 0.4 to 0.6.

Example 2

The metallic shells 1 of the spark plug shown in FIG. 2 were manufactured by use of SWCH8A specified in JIS G 3539 "Carbon Steel Wires for Cold Heading and Cold Forging" and through cold forging (the male-threaded portion 7 was formed through rolling). Dimensions of the metallic shell 1 were as follows:

Outside dimension of tool engagement portion 1*e*, A: 14 mm

Diameter of intermediate-bore portion 40*a*, $D_2$: 9.2 mm

Length of intermediate-bore portion 40*a*, $L_1$: 17 mm

Diameter of major-bore portion 40*b*, $D_1$: 13.06 mm

Effective diameter of male-threaded portion 7, E: 14 mm

Screw reach of male-threaded portion 7, $L_2$: 26.5 mm

Bore diameter of shell-side eccentricity preventive projection 1*s*, $D_3$: 7.5 to 8.6 mm The insulators 2 having the following dimensions were manufactured by use of alumina ceramic.

Overall length of insulator 2, $I_1$: 69 mm

Length of intermediate-trunk portion 2*g*, $I_2$: 18 mm

Length of tip portion 2*i*, $I_3$: 14 mm

Outside diameter of main-body portion 2*b*, d0: 9 mm

Outside diameter of flange portion 2*e*, $d_1$: 11.3 mm

Outside diameter of intermediate-trunk portion 2*g*, $d_2$: 7.3 mm $d_2/D_3$: 0.85 to 0.975.

Figure 7B:
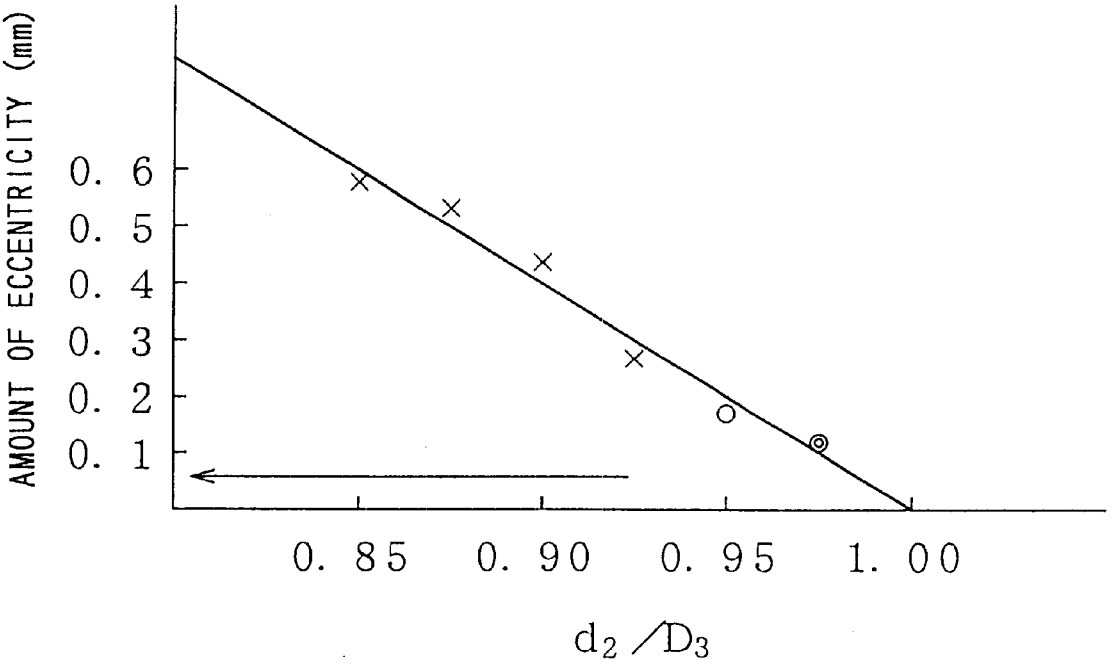
FIG. 7B is a graph showing the test results with respect to example 2.
Figure 9:
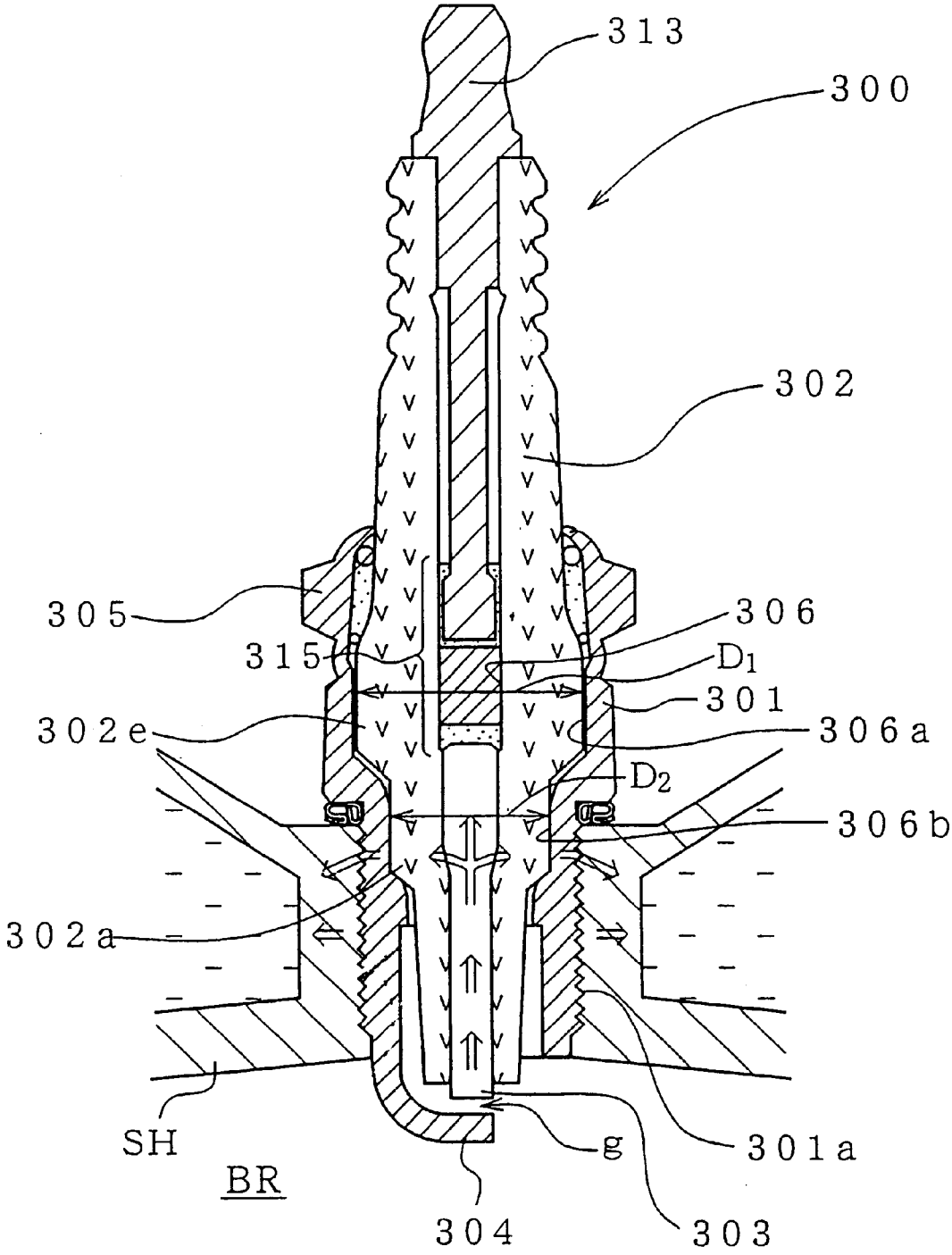
FIG. 9 PRIOR ART
FIG. 9 is a cross-sectional view showing a conventional spark plug.

Through use of the above-manufactured metallic shells 1 and insulators 2, 10 spark plugs shown in FIG. 2 were assembled for each test value of $d_2/D_3$. The assembled spark plugs were measured for a maximum amount of eccentricity of the insulator 2 with respect to the metallic shell 1. The results are shown in FIG. 7B. As seen from FIG. 7B, the amount of eccentricity decreases considerably at a value $d_2/D_3$ of not less than 0.96.

Example 3

The insulators 2 of the spark plug shown in FIG. 1 were manufactured by use of alumina ceramic so as to assume the following dimensions.

Overall length of insulator 2, $I_1$: 69 mm

Length of intermediate-trunk portion 2*g*, $I_2$: 18 mm

Length of tip portion 2*i*, $I_3$: 14 mm

Outside diameter of main-body portion 2*b*, d0: 9 mm

Outside diameter of flange portion 2*e*, $d_1$: 7.7 to 12.15 mm

Outside diameter of intermediate-trunk portion 2*g*, $d_2$: 7.3 mm $d_2/D_3$: 0.6 to 0.95.

Figure 6:
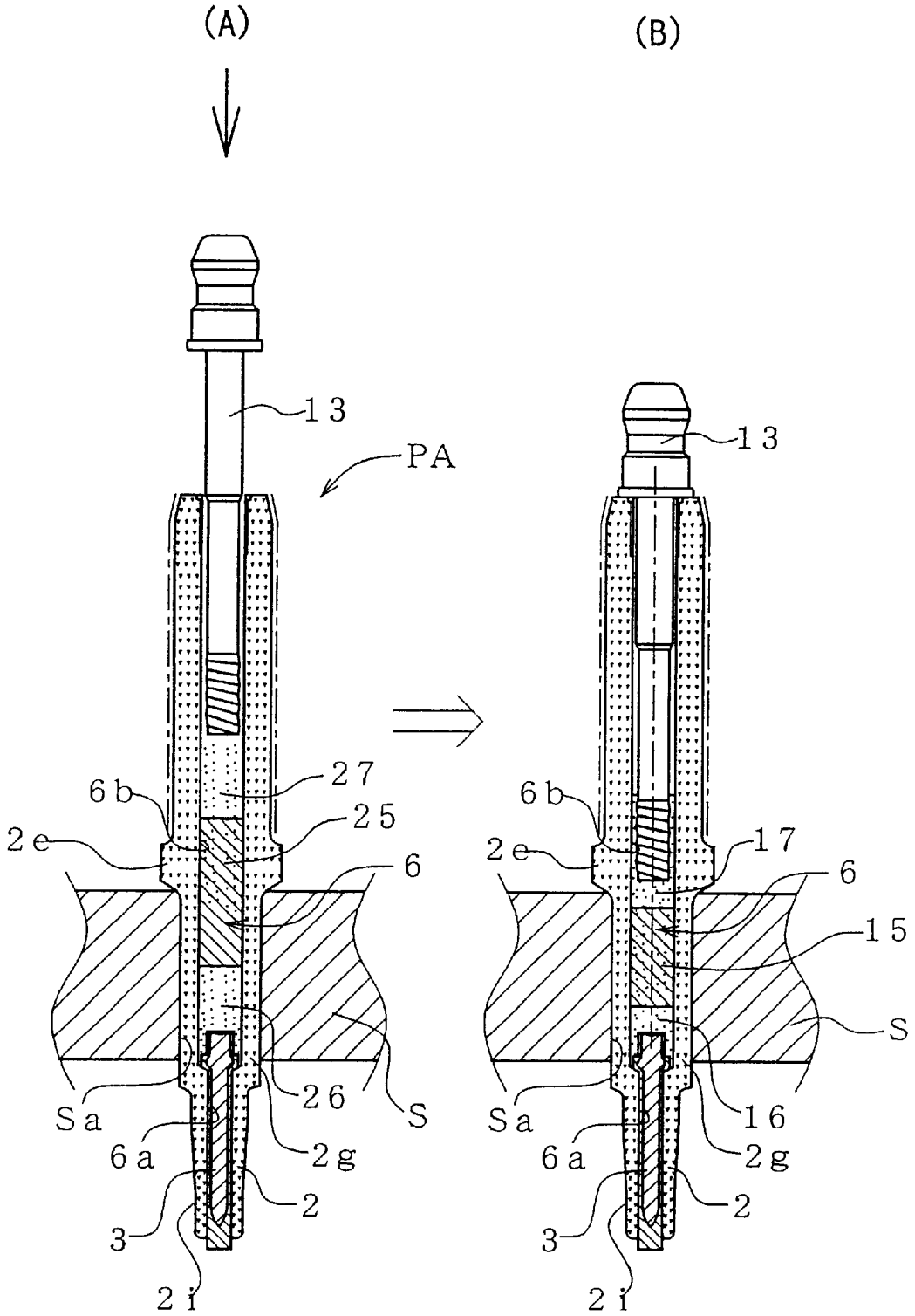

Through use of the above-manufactured insulators 2 and by use of the methods illustrated in FIGS. 5 and 6, the glass seal step was repeated 2000 times for each test value of $d_2/d_1$. The evaluation criteria are as follows:

Circle mark: The seat die and the insulator assembly are both free of any anomaly, and galling does not occur.

X mark: A problem, such as the chipping of the insulator or the galling of the seat die, has occurred.

The results are shown in FIG. 8. As seen from FIG. 8, glass seal productivity is favorable at a value $d_2/d_1$ of not greater than 0.75.

It will be apparent to those skilled in the art that various modifications and variations can be made in the spark plug of the present invention and in construction of this spark plug without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A spark plug comprising:

an elongate center electrode;

an insulator enclosing the center electrode;

a metallic shell having open opposite ends and enclosing the insulator, the metallic shell having a male-threaded portion formed on a front-side outer circumferential surface of the metallic shell, and a tool engagement portion formed on the outer circumferential surface of the metallic shell at a rear side with respect to the male-threaded portion, the tool engagement portion projecting circumferentially outwardly; and a ground electrode connected to the metallic shell and defining a spark discharge gap in cooperation with the center electrode, wherein the insulator has a stepped annular insulator-side engagement portion for engaging with an annular shell-side engagement portion projected inwardly from a portion of an inner surface of the metallic shell corresponding to the male-threaded portion, and $|A-E| \leqq 1.5$ mm, and $0.4 \leqq (D_2/E)^2 \leqq 0.6$, where A is a dimension of the tool engagement portion represented by a diameter of an inscribed circle of a cross-sectional outline of the tool engagement portion, E is an effective diameter of the male-threaded portion, and $D_2$ is an inner diameter of an intermediate-bore portion of the metallic shell located on a rear side with respect to the shell-side engagement portion.

2. The spark plug according to claim 1, wherein 7 mm$\leqq$E$\leqq$14 mm, 4.5 mm$\leqq D_2 \leqq$11 mm, and 1.5 mm$\leqq(E-D_2)\leqq$5.2 mm.

3. The spark plug according to claim 2 further comprising a flange portion formed on an outer circumferential surface of the insulator on a rear side with respect to the stepped portion, and wherein $d_2/d_1 \leqq 0.75$, where $d_1$ is an outside diameter of the flange portion, and $d_2$ is an outside diameter of an intermediate-trunk portion extending between the flange portion and the stepped portion.

4. The spark plug according to claim 3, wherein 6 mm$\leqq d_1 \leqq$13 mm, 4.5 mm$\leqq d_2 \leqq$10 mm, and 1.5 mm$\leqq(d_1-d_2)\leqq$8 mm.

5. The spark plug according to claim 3 further comprising a predetermined gap formed between the intermediate-bore portion of the metallic shell and the intermediate-trunk portion of the insulator, and an eccentricity preventive portion provided substantially concentrically with the intermediate-bore portion and the intermediate-trunk portion, the eccentricity preventive portion partially filling the gap to prevent an eccentric disposition of the insulator within the metallic shell.

6. The spark plug according to claim 5, wherein the eccentricity preventive portion is a shell-side eccentricity preventive projection circumferentially projected from an wall surface of the intermediate-bore portion.

7. The spark plug according to claim 6, wherein $0.96 \leqq d_2/D_3 \leqq 1$, and $Q \geqq 1$ mm, where $D_3$ is a bore diameter of the shell-side eccentricity preventive projection, and Q is an axial length of the shell-side eccentricity preventive projection.

8. The spark plug according to claim 5, wherein the eccentricity preventive portion is an eccentricity preventive ring disposed around the intermediate-trunk portion of the insulator.

9. The spark plug according to claim 8, wherein $0.96 \leqq \delta/D_2 \leqq 1.1$, $0.96 \leqq d_2/D_3 \leqq 1$, and $Q \geqq 1$ mm, where $\delta$ is an outside diameter of the eccentricity preventive ring, $D_3$ is a bore diameter of the eccentricity preventive ring, and Q is an axial length of the eccentricity preventive ring.

10. The spark plug according to claim 5, wherein the eccentricity preventive portion is an insulator-side eccentricity preventive projection circumferentially projected from an outer circumferential surface of the intermediate-trunk portion of the insulator.

11. The spark plug according to claim 10, wherein $0.96 \leqq \delta_2/D_2 \leqq 1$, and $Q \geqq 1$ mm, where $\delta_2$ is an outside diameter of the insulator-side eccentricity preventive projection, and Q is an axial length of the insulator-side eccentricity preventive projection.

* * * * *